US009121671B2

(12) United States Patent
Everett

(10) Patent No.: US 9,121,671 B2
(45) Date of Patent: Sep. 1, 2015

(54) SYSTEM AND METHOD FOR PROJECTING REGISTERED IMAGERY INTO A TELESCOPE

(75) Inventor: Jonathan Edward Everett, Arlington, MA (US)

(73) Assignee: General Dynamics Advanced Information Systems, Fairfax, VA (US)

( * ) Notice: Subject to any disclaimer, the term of this patent is extended or adjusted under 35 U.S.C. 154(b) by 675 days.

(21) Appl. No.: 13/354,137

(22) Filed: Jan. 19, 2012

(65) Prior Publication Data

US 2012/0182417 A1 Jul. 19, 2012

Related U.S. Application Data

(60) Provisional application No. 61/457,163, filed on Jan. 19, 2011.

(51) Int. Cl.

| | |
|---|---|
| ***F41G 1/00*** | (2006.01) |
| ***F41G 1/38*** | (2006.01) |
| ***F41G 1/30*** | (2006.01) |

(52) U.S. Cl.
CPC ... *F41G 1/38* (2013.01); *F41G 1/30* (2013.01)

(58) Field of Classification Search
CPC ..... G01B 11/022; G01B 11/024; H04N 7/18
USPC ..... 348/135
See application file for complete search history.

(56) References Cited

U.S. PATENT DOCUMENTS

| | | | | |
|---|---|---|---|---|
| 5,555,662 | A * | 9/1996 | Teetzel | 42/115 |
| 6,269,581 | B1 * | 8/2001 | Groh | 42/122 |
| 6,321,478 | B1 * | 11/2001 | Klebes | 42/84 |
| 6,412,207 | B1 * | 7/2002 | Crye et al. | 42/70.06 |
| 6,590,386 | B1 * | 7/2003 | Williams | 324/178 |
| 6,813,025 | B2 * | 11/2004 | Edwards | 356/422 |
| 7,654,029 | B2 * | 2/2010 | Peters et al. | 42/111 |
| 7,690,145 | B2 * | 4/2010 | Peters et al. | 42/111 |
| 7,699,683 | B2 * | 4/2010 | Caspi | 446/456 |
| 8,464,451 | B2 * | 6/2013 | McRae | 42/1.01 |
| 2005/0198885 | A1 * | 9/2005 | Staley, III | 42/142 |

* cited by examiner

*Primary Examiner* — Jay Patel
*Assistant Examiner* — Frank Huang
(74) *Attorney, Agent, or Firm* — Ingrassia, Fisher & Lorenz, P.C.

(57) ABSTRACT

Systems and methods are provided to automatically determine a position of a reticle of a rifle scope or other telescope that provides a visual image to an eye of a viewer. A near-infrared or other illuminating light is generated and applied to illuminate the reticle of the telescope. The illuminated image of the reticle is optically transmitted to a camera or other detector that captures an image of the reticle. Processing electronics then automatically determine the position of the reticle based upon the position of the illuminated image of the reticle within the captured image. Appropriate feedback about the determined position of the reticle or any other information may be displayed in the visual image provided by the telescope.

18 Claims, 19 Drawing Sheets

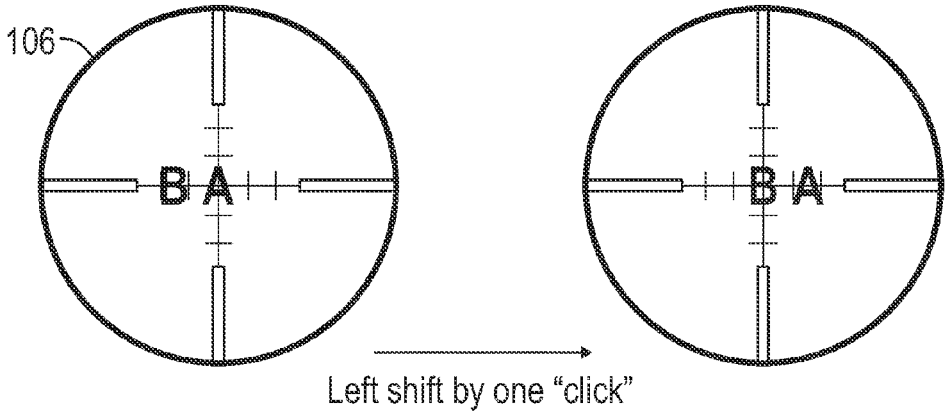
FIG. 2
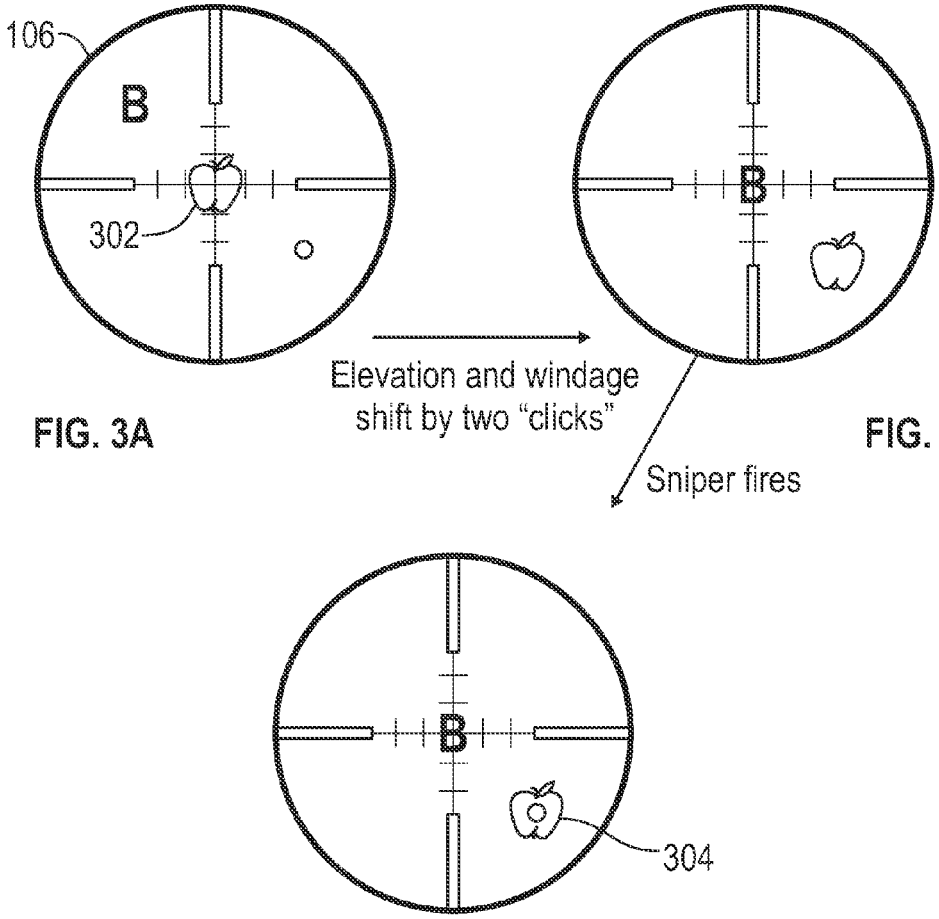
FIG. 3A
FIG. 3B
FIG. 3C

| | | | Microradians | | | | | | |
|---|---|---|---|---|---|---|---|---|---|
| | | | | | | | | | Runs 6-10 |
| | W,E Location -> | | 0,0 | 1,1 | 2,2 | 3,3 | 4,4 | 5,5 | 0,0 |
| Measurement | Reticle Adjustment | X | 0 | 73 | 145 | 218 | 291 | 364 | 0 |
| | | Y | 0 | 73 | 145 | 218 | 291 | 364 | 0 |
| | Standard Deviation | X | 8 | 31 | 27 | 29 | 36 | 27 | 13 |
| | | Y | 7 | 11 | 11 | 50 | 13 | 12 | 13 |
| | Average | X | 0 | 57 | 143 | 205 | 278 | 359 | -38 |
| | | Y | 0 | 63 | 146 | 211 | 282 | 355 | -2 |
| | Mean Error | X | 0 | -16 | -3 | -13 | -13 | -5 | -38 |
| | | Y | 0 | -9 | 0 | -7 | -9 | -9 | -2 |

FIG. 17

| Error Bin (urads) | Frequency | Cumulative % |
|---|---|---|
| 10 | 40 | 57.14% |
| 20 | 11 | 72.86% |
| 30 | 10 | 87.14% |
| 40 | 3 | 91.43% |
| 50 | 3 | 95.71% |
| 60 | 2 | 98.57% |
| 70 | 1 | 100.00% |
| 80 | 0 | 100.00% |
| 90 | 0 | 100.00% |
| 100 | 0 | 100.00% |
| More | 0 | 100.00% |

SYSTEM AND METHOD FOR PROJECTING REGISTERED IMAGERY INTO A TELESCOPE

PRIORITY CLAIM

This application claims priority to U.S. Provisional Patent Application Ser. No. 61/457,163, "System and Method for Projecting Registered Imagery into a Telescope", filed on Jan. 19, 2011, which is incorporated herein by reference.

TECHNICAL FIELD

The following discussion relates to projecting imagery into a telescope such as a scope mounted on a rifle. More specifically, the following discussion describes optically locating line-of-sight reference features of a telescope by imaging into the telescope and isolating those reference features in a reference image. For purposes of brevity and illustration, the following discussion emphasizes use in a rifle scope for a sniper-type application. Equivalent concepts could be readily applied to any sort of telescope, however, including those used in target shooting, image acquisition, photography, or for any other purpose.

BACKGROUND INFORMATION

Sniper teams typically include two members. The first is the sniper, who physically wields the weapon. The second is a spotter, who provides situational information to the spotter. The spotter is typically responsible for monitoring environmental conditions such as wind speed(s) and temperature, for example, as well as the range to the target and any other information that may effect the trajectory of the projectile as it proceeds toward the target.

Referring to FIG. 1, a basic sniper rifle 100 is shown. The sniper rifle 100 includes a weapon 102 and a telescope 104, commonly called a "scope". The weapon 102 is the actual "gun" that fires the bullet. The scope 104 is typically an adjustable magnifying optical system to isolate targets of interest. The internal optics of the scope generally provide a physical reticle 106 that is typically etched in glass in the optical path of the scope 104. Often, the physical reticle 106 is a simple a cross hair with markers. For sake of brevity, further discussion focuses on the cross hairs with markers, although any shape can be equivalently used.

The scope 104 is adjustably connected to the weapon 102. As discussed more fully below, on occasion a sniper may need to adjust the position of the scope 104 relative to the weapon 102. This movement is generally achieved by a variety of knobs 112 located along the outer periphery of scope 104. One such knob 112 will typically control the "elevation" of the scope 104, which causes the scope 104 to rotate around its X-Z axis to account for up/down changes relative to target. Another such knob 112 will typically control the "windage" of the scope 104, which causes the scope 104 to rotate around the X-Y axis to account for left/right changes relative to target. A third knob 112 will typically control "parallax" of the scope 104, which raises and lowers the scope 104 in the z-x plane. Additional knobs, buttons and/or other controls may also be provided for focus, magnification, aperture control, and/or the like.

All of the knobs 112 generally have specific set positions that will "click" when the knob is moved into that position. Although the knobs could be adjusted by sight, in practice the "click" provides a tactical response that allows the sniper to adjust the knob settings via touch without having to take his or her eye off the target. The adjustment that results from knob rotation of a single "click" is usually consistent with a one hash-mark change in the reticle 106. Thus, by way of non-limiting example and referring to FIG. 2, a one click rotation to the left would adjust the scope 104 such that the optical path would shift by one hash-mark to the left (replacing B in the center of the reticle with A).

Sniper rifle 100 is initially calibrated through a process often referred to as "zeroing the reticle." The goal is to align the center of the reticle 106 with the boresight of the weapon 102 (a straight line trajectory between the weapon 102 and the target). Generally speaking, the sniper wants the bullet to penetrate a target at exactly the dead center of reticle 106 under ideal conditions.

The sniper brings the rifle 100 to a controlled environment with zero elevation and zero lateral movement, sets the target at a distance at which vertical drop of the bullet due to gravity is not a factor, aligns the center of the reticle 106 with the target, and fires. If the scope 104 is in proper alignment with the weapon 102, the bullet will strike the target at the dead center of the reticle 106. If the bullet strikes somewhere else, then the weapon 102 is out of alignment with scope 104; the sniper adjusts the position of the scope 104 by adjusting the knobs 112 and repeats the process until proper alignment is achieved.

Despite what is now near-perfect alignment of the sniper rifle 100, when used in distances common for sniper conditions (e.g., typically on the order of 300 meters or more for military use) the bullet is nevertheless unlikely to strike the target as centered in the reticle 106 due to a variety of conditions that can effect the movement of the bullet over such large distances. Such conditions include, for example, wind, humidity, temperature, gravity and the like. Wind can be a particularly influential condition that can change rapidly and radically. Additionally, weapon and ballistics conditions such as the size, shape, velocity, mass and/or temperature of the bullet can affect the travel of the bullet.

The role of the spotter, then, is to account for as many of these conditions as possible and to evaluate, as best possible, what adjustments can to be made to the sniper's aim to compensate. That is, the spotter's job is typically to determine the optimum deviation from the boresight of the sniper's weapon 102 to increase accuracy. To illustrate, FIG. 3A shows one example in which the sniper aligns the reticle 106 with the target 302. The spotter determines, for example, that because of extreme distance to the target the bullet will drop due to gravity such that the sniper's current aim is too low by two hash marks. The spotter in this instance also determines that a left-to-right wind will push the bullet to the right such that the sniper's aim is too far to the right by two hash marks. Due to these conditions, the bullet fired as shown in the example of FIG. 3A would strike the area shown by dot 304, missing the target.

To compensate for these conditions, the spotter would typically communicate to the sniper to adjust the aim of the rifle up and to the left by two hash marks in each direction, essentially centering the reticle 106 on the "B" location as shown in FIG. 3B. The sniper then fires; if the calculations are correct and no other adverse conditions are in play, the bullet aimed at point B in the scope 104 should drop due to gravity and move to the right via wind to strike the target 302, thereby making a hole 304 dead center in the target 302. Similar concepts could be applied to any number of other examples relating to any number of compensatable factors.

A complicating factor in the spotter's calculations is to take into account the current position of the scope 104, which may (or may not) have been adjusted since it was first aligned. As noted above, conventional scope adjustments are relative rather than absolute. More specifically, there is not presently any absolute position (e.g., geographic position, such as GPS coordinates) that the spotter calculates. Rather, scope compensation is based on the position of the scope 104 relative to the necessary correction. The spotter and/or sniper therefore needs to know how the scope 104 is currently positioned so that information can be used in determining how to compensate for the proper offset.

In practice, the sniper team generally uses a specific pre-agreed upon vocabulary to communicate compensation information between the spotter and the sniper, often in units of "clicks" that correspond to movements of knobs 112 of the scope 104. For example, the sniper can communicate current scope orientation as "one-click left, four-clicks up" or "−1 windage, +4 elevation" to inform the spotter as to the current orientation of the scope 104 relative to the zero alignment. The spotter then calculates how the sniper should adjust his or her weapon to compensate for the shot; for example, the spotter may say "one click to the left, three clicks down." In the example illustrated in FIG. 3, the offset "B" is to the upper left, so the spotter may relay compensation data such as "2 clicks left, 2 clicks up" to the sniper.

The sniper will typically respond to this compensation data in one of two ways corresponding to either (1) movement of the weapon 102 or (2) readjustment of the scope 104. The first method, as shown in FIG. 3A-C, would be for the sniper to simply adjust the angle of the rifle to align the cross hairs by the desired amount. In the example of FIG. 3B, the sniper intending to hit point "A" would move the weapon so that reticle centers on point "B". The sniper then fires; if the compensation data was accurately calculated and applied, the bullet may (as discussed below) strike target 302, as shown by hole 304. An advantage of this method is that the sniper does not change the scope 104 from its calibrated alignment. A disadvantage is that the sniper takes the reticle off the target and "eyeballs" how to realign his weapon to make the correction per the number of clicks. That is, the sniper does not aim directly at the target, thereby inherently leading to imprecision.

The second method of responding to compensation data would be for the sniper to physically adjust the scope 104 by turning the knobs 112 by the amount instructed by the spotter. An advantage of re-orienting the scope 104 with respect to the weapon is that the reticle 106 will then be directly over the target 302 when the shot is taken. The disadvantage, however, is the weapon is now out of its original alignment. This deviation from the original alignment would need to be considered for subsequent shots until the scope 104 is restored to its default setting at a later time.

Despite the best efforts of the sniper and spotter, shots can still miss due to environmental effects, errors, and/or other factors. Environmental factors refers to undetected factors that could not be properly accounted for in the spotter's calculations. Wind conditions proximate to the target, for example, could be significantly different from those measured at the spotter's location. The target could also be behind a certain type of glass or other barrier that alters the angle of the bullet. Any number of other environmental effects could alternately or additionally be present.

Inaccuracy also results from imprecision or other error. Errors could arise for any number of practical factors including: error in communication/tracking of the actual position of the scope 104; error in the calculation of the number of clicks needed; error by the sniper in applying the clicks; latency, and/or the like. Latency can occur during the few seconds between the spotter providing the compensation information and the spotter firing the shot, during which time external conditions may already have changed such that the prior calculations are outdated. The impact of such errors in best viewed in context: the desired location of a sniper shots may be the target's chest, which is usually an area roughly 10-14 inches wide. But for a sniper shot at 2500 meters, a one click "error" would translate into a roughly 10 inch deviation off the desired target point, corresponding to almost a full body width. Even the smallest error can thus be the difference between hitting and missing the target. In this context, the term "error" is used to refer to any sort of human inaccuracy that is inevitably present in any situation. The use of the term is by no means intended to disparage the fine efforts or work of American servicemen. Indeed, a lethal hit on the first bullet is considered unlikely in practice due to the frequency and impact of environment and error.

When the first shot misses, however, the sniper can usually see where the bullet strikes. The distance between the impact point and the target point provides the sniper with an instantaneous second set of compensation data that allows for an improved second shot. The split-second nature of this circumstance, however, generally dictates that the second shot be taken with the first method above (weapon 102 realignment) rather than the second method (scope 104 realignment).

The above methodology can have various drawbacks. As noted above with respect to the missed shot, the process allows for human error in determining, communicating and/or applying compensation data. The information is also communicated orally, thereby creating latency and increasing the probability of detection.

Research is underway to design equipment that would more automatically and efficiently perform the compensation calculation and provide corresponding compensation data. However, no technique or system currently exists for the spotter and sniper to exchange the information discussed above in a meaningful way that avoids various drawbacks. These and other desirable features and characteristics will become apparent from the subsequent detailed description and the appended claims, taken in conjunction with the accompanying drawings and this background section.

BRIEF DESCRIPTION OF THE DRAWING FIGURES

Exemplary embodiments will hereinafter be described in conjunction with the following drawing figures, wherein like numerals denote like elements, and FIG. 1 is a drawing of an exemplary sniper rifle with a telescope and reticle;

FIG. 2 illustrates the shift of an exemplary reticle;

FIGS. 3A-C illustrate the shifting of an exemplary reticle to increase the likelihood of hitting a target;

FIG. 4 is a block diagram of an exemplary system to determine the position of the reticle and to project feedback information about the position of the reticle to the telescope;

FIGS. 5A-F describe an exemplary scenario for compensated aim based upon an automatic determination of the reticle position;

FIGS. 6A-F show various views of an exemplary external camera device;

Figure 15:
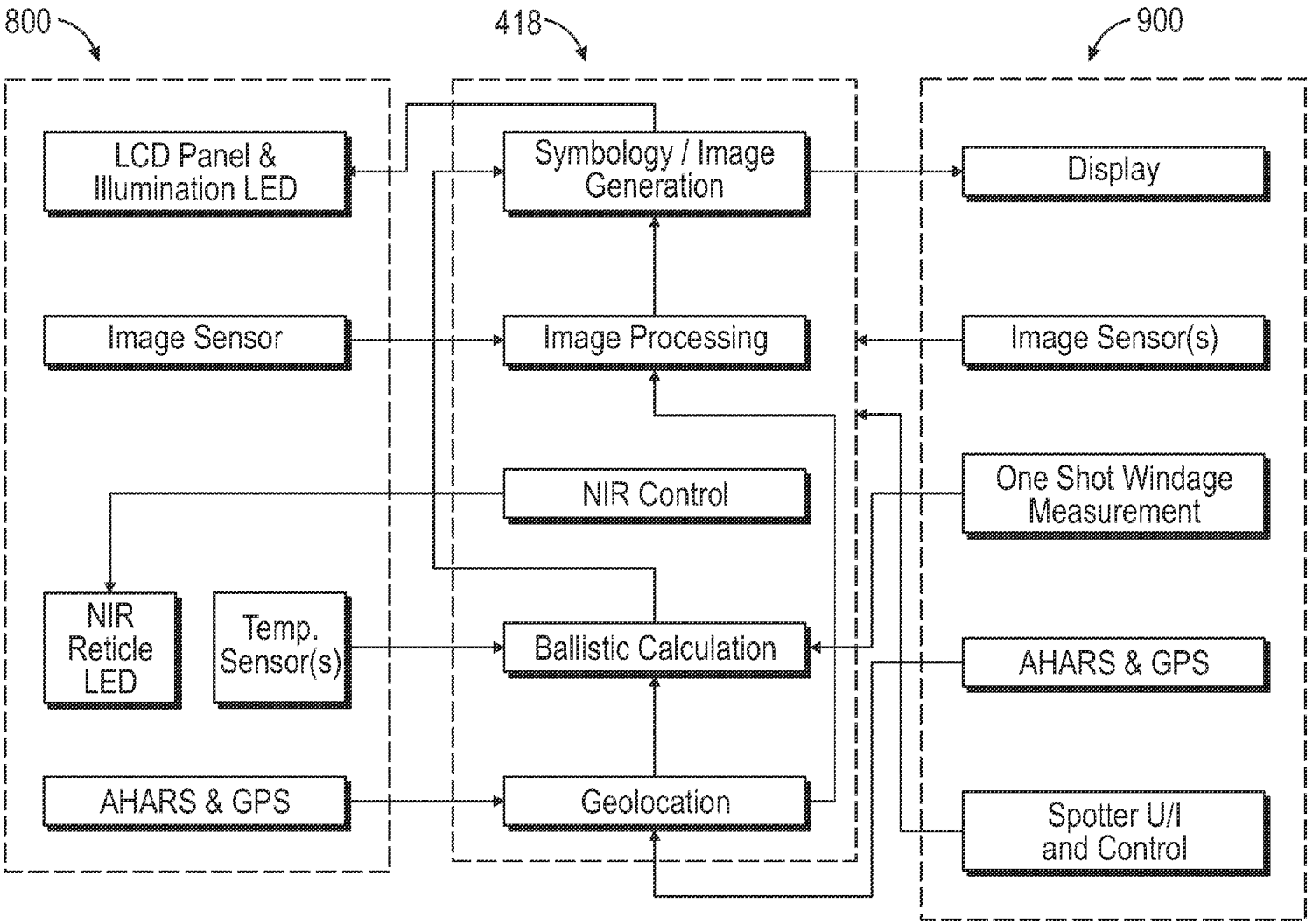
Figure 16:
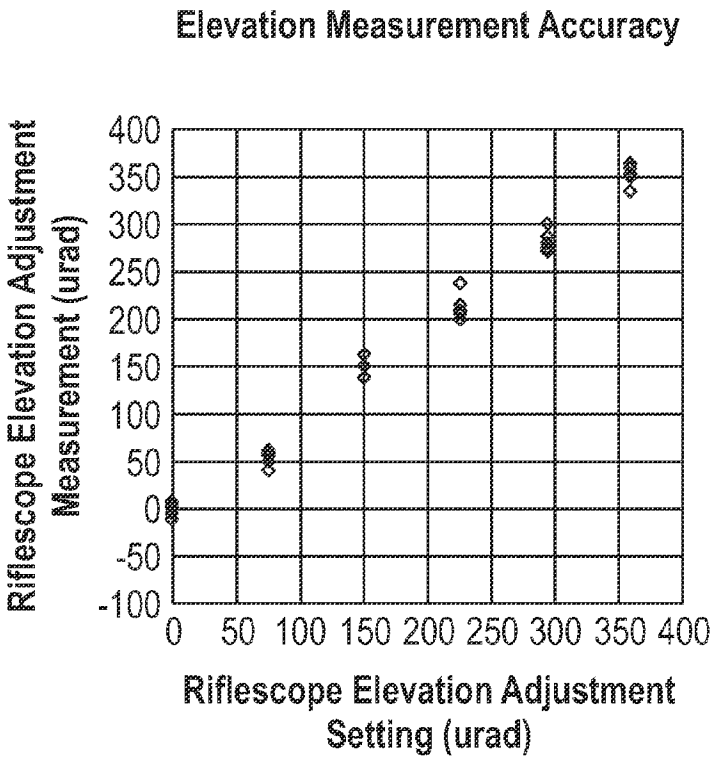
Figure 16:
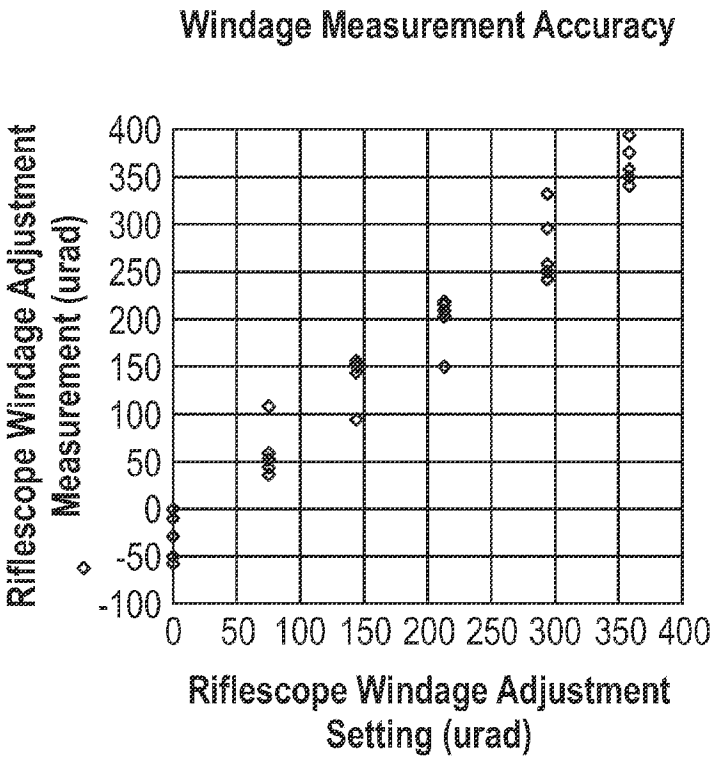
Figure 16:
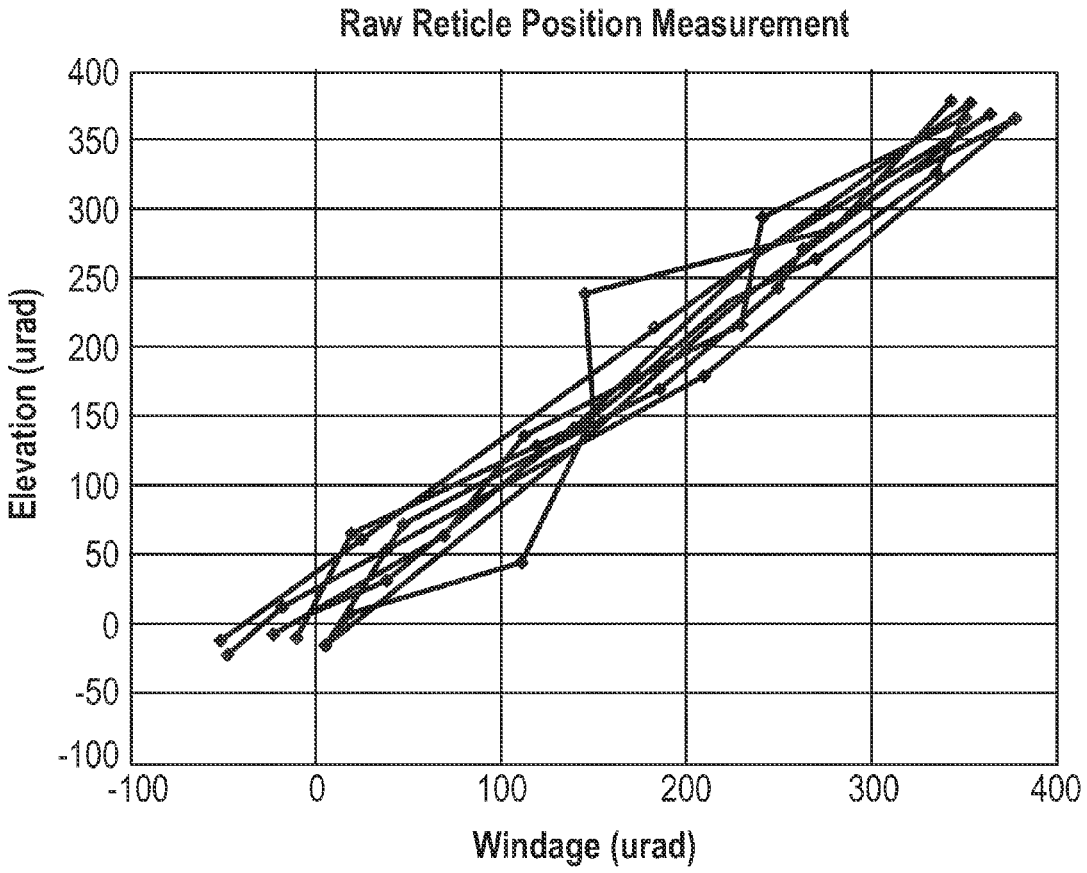
Figure 17:
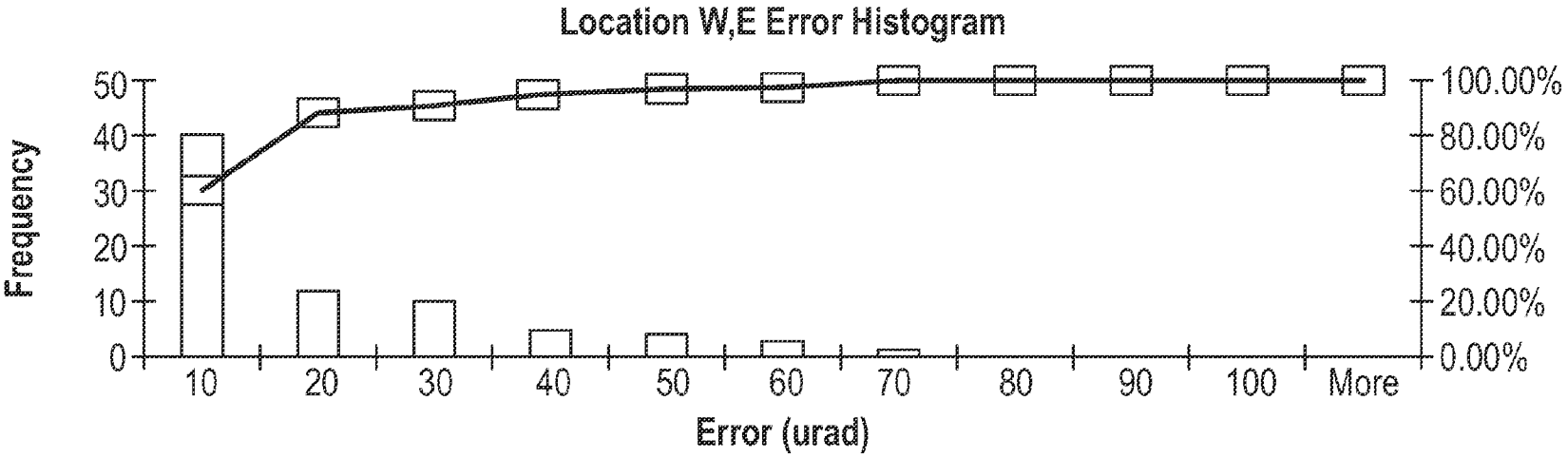

FIGS. 11A-C, 12A-F, 13 and 14 illustrate exemplary targeting scenarios using information obtained from an external image capture device;

FIG. 15 is a block diagram of an exemplary detection and targeting system; and FIGS. 16 and 17 show test results obtained from one exemplary embodiment.

DETAILED DESCRIPTION OF EXEMPLARY EMBODIMENTS

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

According to various embodiments, systems, methods and/or apparatus are provided to automatically determine a position of a reticle of a rifle scope or other telescope that provides a visual image to an eye of a viewer. In various embodiments, a near-infrared or other suitable illuminating light is generated and applied to illuminate the reticle of the telescope. The illuminated image of the reticle is optically transmitted to a camera or other detector that captures an image of the reticle. Processing electronics then automatically determine the position of the reticle based upon the position of the illuminated image of the reticle within the captured image. Appropriate feedback about the determined position of the reticle or any other information may be displayed in the visual image provided by the telescope.

Figure 1:
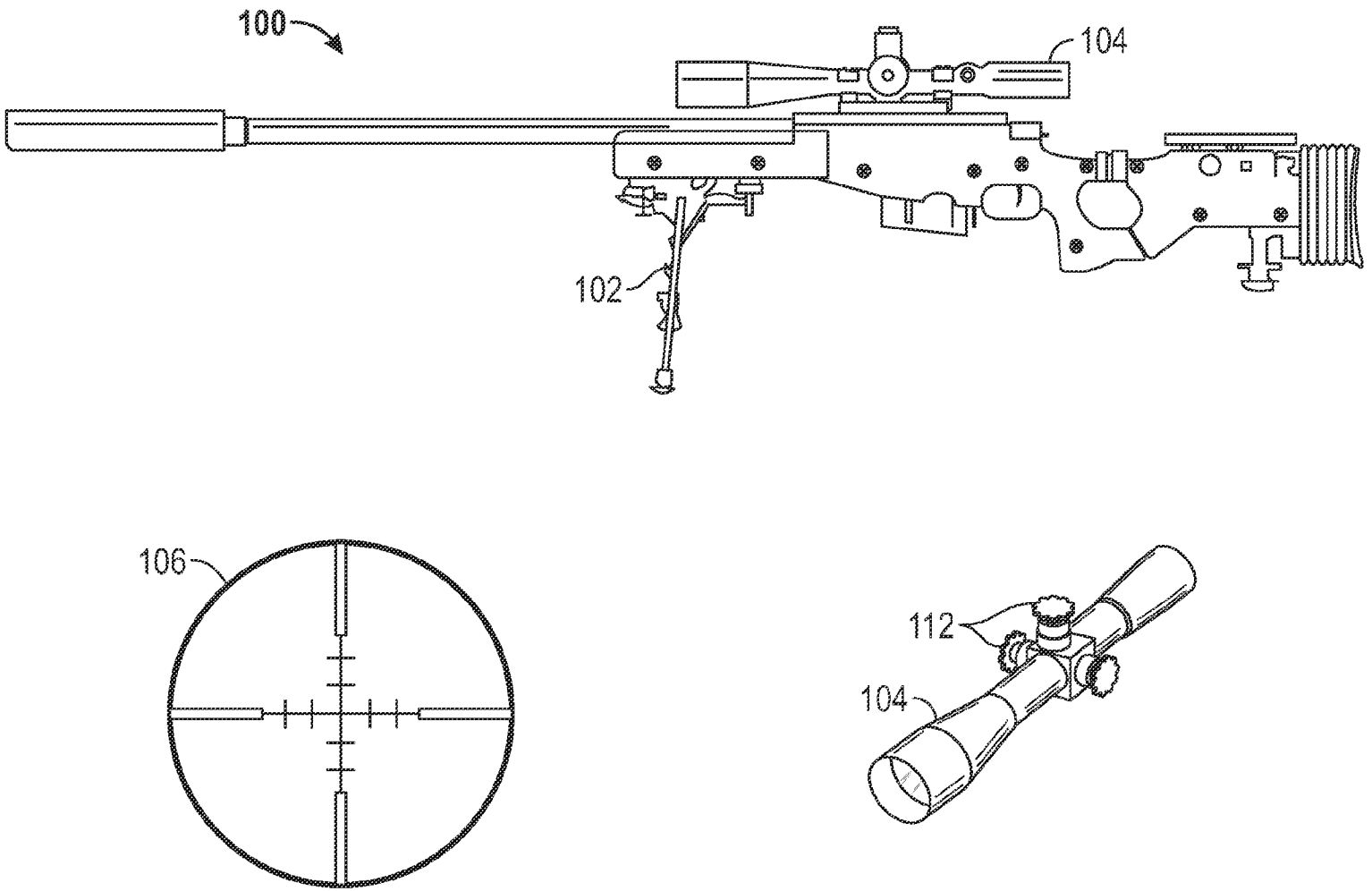
FIG. 1 (Prior Art)
Figure 4:
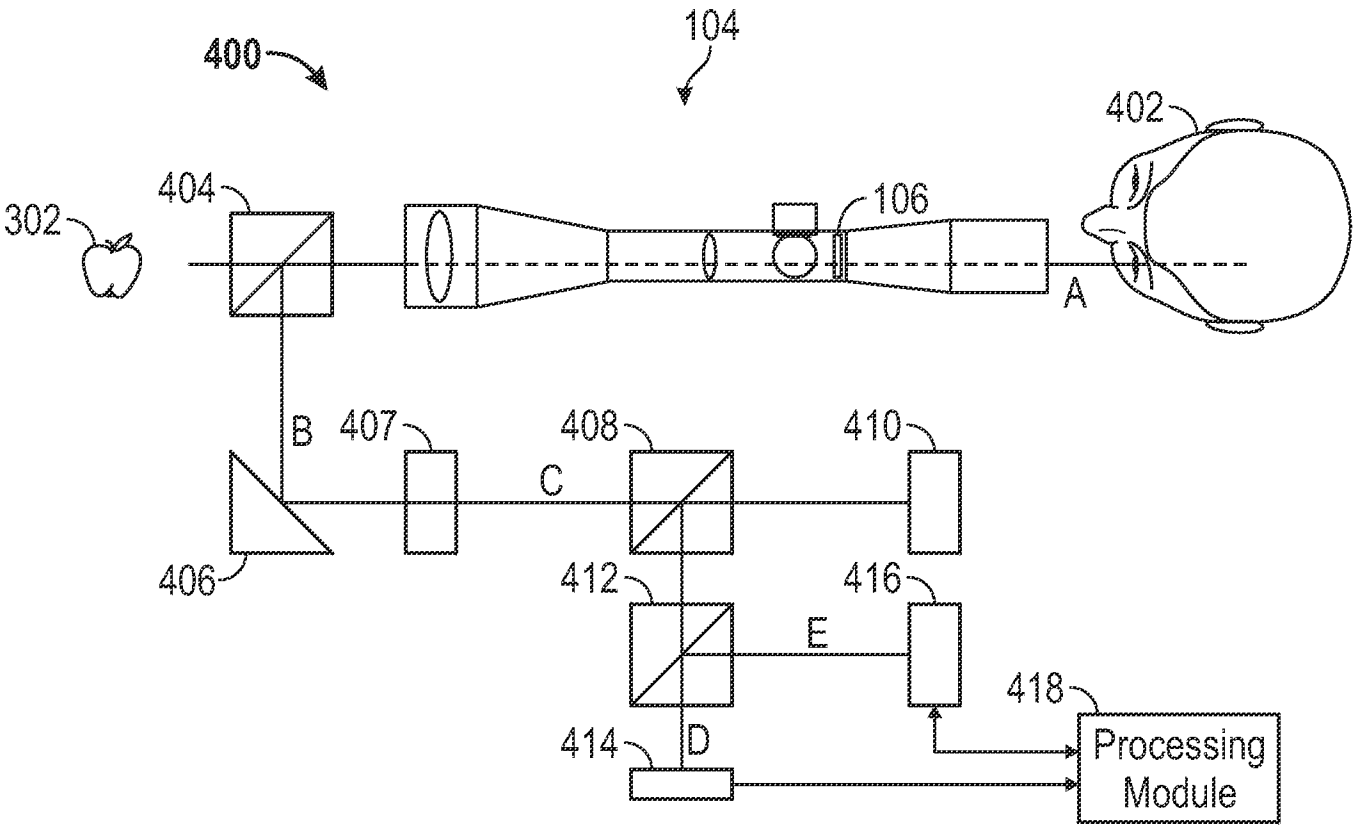

Referring now to FIG. 4, the optics of an embodiment of a reticle projection system 400 is shown. The environment includes the scope 104 with a glass plate that supports reticle 106. The scope 104 is illustrated to be aligned between the target 302 and the eye 402 of the sniper along an optical path A; however, as discussed below, the scope 104 is often not aligned with optical path A due to any number of reasons.

The reticle projection system 400 shown in FIG. 4 suitably includes a first beam splitter 404 that is illustrated to be aligned in the optical pathway A. As discussed in more detail below, first beam splitter 404 is preferably highly transmissive and minimally reflective to visible light (e.g. for light within the visible spectrum range of about 450-750 nm) so that a visual image can be transmitted to the eye of the sniper or other viewer. First beam splitter 404 is also preferably highly reflective and minimally transmissive for light in the near infra-red spectrum (e.g., for light within the range of about 750-1000 nm or so) for directing illuminating light into the telescope 104.

The reflective characteristic of first beam splitter 404 reflects light between optical path A to optical path B, which extends in FIG. 4 to a mirror 406. Mirror 406 in this example reflects light between optical path B and optical path C. Optical paths A and C are illustrated in FIG. 4 to be substantially parallel and perpendicular to optical path B, although other embodiments may be differently oriented as desired.

Optical path C is shown to extend through an objective lens assembly 407 toward a second beam splitter 408. The transmissive characteristic of second beam splitter 408 extends optical path C toward a near infrared light source 410 that preferably emits illuminating light that is used to obtain a reflected image of the reticle. The illuminating light may be produced at a suitable wavelength of greater than 700 nm (e.g., 750-1000 nm, more preferably 750-850 nm, and particularly about 780 nm). The light preferably has as narrow of a spectral width as practically available (e.g., about 5 nm or so) to balance between minimizing the risk of visibility of the near IR light, maximizing the reflected light from the eye, minimizing the stray reflected light from the rifle scopes due to being out of it's optimized waveband, and maximizing the response of the camera 414 to the near IR light. A narrow bandwidth also assists in simplifying the lenses and lens coatings for high resolution and contrast imagery. Other wavebands, however, could be used in any number of other embodiments. The reflective characteristic of second beam splitter 408 suitably reflects light between optical paths C and D. Optical path D is shown to extend to a third beam splitter 412. Other embodiments may be differently organized, or may include alternate components as appropriate.

The transmissive characteristic of third beam splitter 412 extends optical path D toward n image capture device 414, preferably a camera such as a CCCD or CMOS camera. The reflective characteristic of third beam splitter 412 in this example reflects light between optical path D and optical path E. Optical path E is shown to terminate in a video display 416 that is aligned with optical path E, as described more fully below. Camera 414 and video display communicate through a wired connection or wirelessly with a processing module 418. To that end, processing electronics 418 may be part of reticle projection system 400, an independent external component, or incorporated into another device such as spotter's camera. Processing electronics 418 may be implemented with any sort of microprocessor, microcontroller, digital signal processor, programmed logic array or other hardware. In some embodiments, processing electronics 418 may be implemented with a general purpose processor that executes software stored in memory or other storage available to the processor.

A variety of additional optical lenses may be present in optical paths A-E and are discussed below, but are omitted in FIG. 4 for ease of view. It is to be understood that the additional optics are present and manipulating the light streams of FIG. 4. The collection of beam splitters and other intervening optics make up the optical system of reticle projection system 400. The specifics of the individual lens elements to direct the light as noted are not critical beyond directing light to its intended destination, and are known to those of skill in the art of lens design.

Figure 6A:
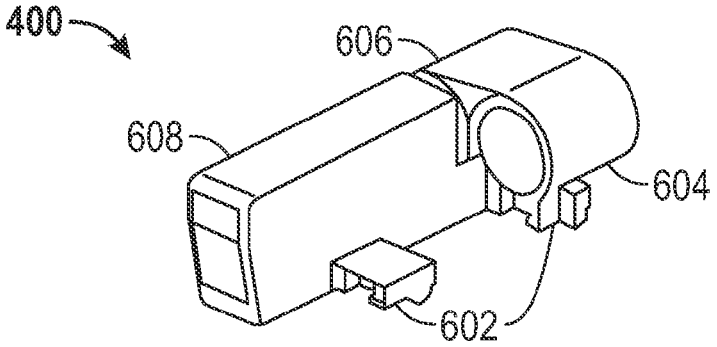
Figure 6B:
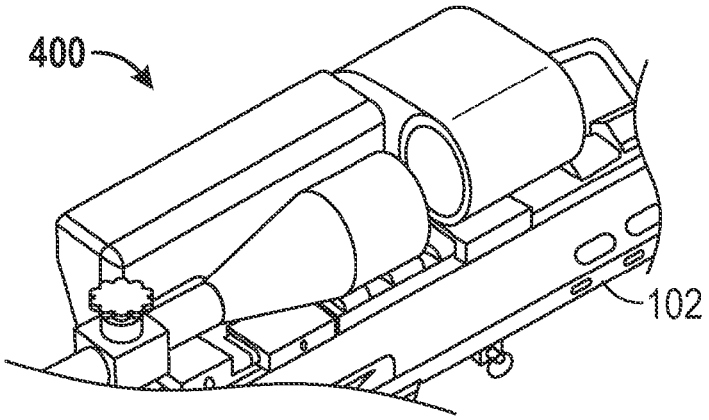
Figure 6C:
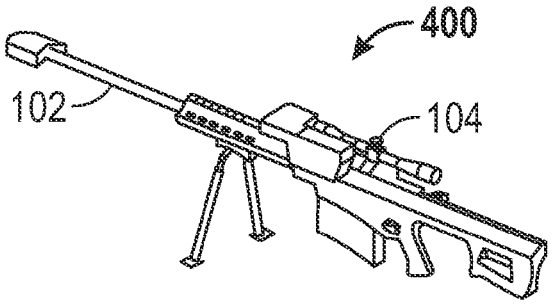
Figure 6D:
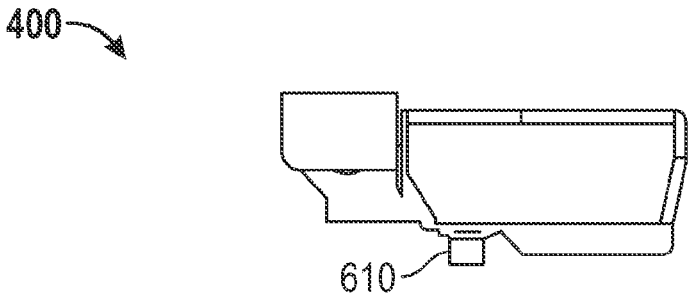
Figure 6E:
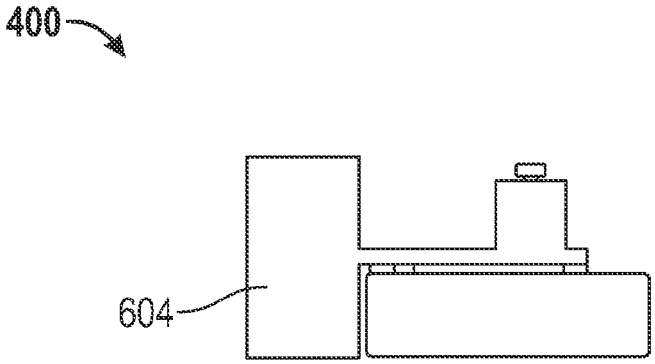
Figure 6F:
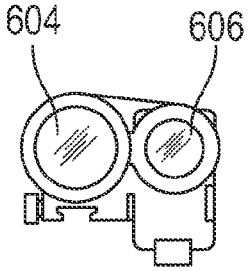

Referring now to FIGS. 6A-6F, an embodiment of the physical housing of the reticle projection system 400 is shown. FIGS. 6D-F show side, top and front views of system 400 along with preferred dimensions in inches. FIG. 6A shows a perspective view of the system 400 itself, while FIGS. 6B and 6C show the system 400 clipped on to a weapon 102 relative to scope 104. The outer shell is preferably made of and/or covered with appropriate materials, such as anti-reflective surfaces or camouflage patterns.

A tube 604 both holds beam splitter 404 and provides a sunshade against exterior light. The interior of tube 604 is preferably large enough so as not to interfere with the line of sight of scope 104, and is preferably coated on the interior with non-reflective coatings or materials. Another tube 606 supports the mirror 406. An I/O connector 610 provides a wired connection between internal electronics of reticle projection system 400 and an external device such as the processing module and/or a spotter's camera, if desired. I/O connector 610 could also be an antenna of a wireless connection.

The remaining optical and electrical components of reticle projection system 400 are generally disposed within a housing 608. Housing 608 generally has shock-absorbing characteristics to attenuate G-forces induced by firing the weapon and to prevent adverse affects to the components within housing 608. A material in the external shell akin to visco-elastic urethane or the like may be adequate for this purpose, although other attenuating methodology or mechanism may be used in other embodiments. In the example of FIG. 6, two rail mounts 602 attach the reticle projection system 400 onto the weapon 102. The embodiment of FIG. 6 is thus shown as a clip-on attachment which can be used within any standard rifle scope. However, the invention is not so limited, reticle projection system 400 could be combined with the scope 104 to form an integral unit.

The operation of the reticle projection system 400 will now be described. As discussed above, adjustments in the weapon 102 are relative to the current orientation of scope 104, and in the prior art it was necessary for the spotter and/or sniper to track the current position of the scope 104 as part of determining the corresponding compensation data. The embodiment herein provides that same information optically and automatically.

In the absence of power, none of light source 412, video display 414 and/or camera 416 are typically operational. Scope 104 thus performs consistently with the prior art in this regard, except that the optical path of scope 104 intersects beam splitter 404. The beam splitter is preferably high transmissive to the visible light spectrum (e.g., at about 450-750 nm, preferably at 85-95% transmissive, and particularly at least about 90% transmissive) so as not to interfere with normal operation of scope 104 in which a visual image of the target area is provided to the sniper/viewer.

When the electronics of reticle projection system 400 are activated, near infrared light source 410 generates and emits an illuminating light that may be in the near-infrared band and that travels along optical path C. The illuminating light reflects to optical path B via mirror 406 toward beam splitter 404. As noted above, beam splitter 404 is preferably highly reflective for near infrared light, and thus reflects the near infra red light from optical path B along optical path A into scope 104.

In the embodiment of FIG. 4, illuminating light initially passes the reticle 106 and enters the sniper's eye 402. Unlike visible spectrum light that the human eye mostly absorbs, the human eye reflects a greater portion of the near infra red light. This reflected illuminating light therefore reenters scope 104 a long optical path A, illuminating reticle 106. Not only does the sniper's eye see the reticle 106, then, but also the human eye acts as an illumination source of reflected near infrared light that illuminates reticle 106 in the outgoing direction of optical path A.

In the alternative, another reflective surface could be used at the back of scope 104, either a mirror (which could be moved in and out of the optical pathway) or a beam splitter. Like the combiner 404, such a reflector could be reflective in the near-infrared band and highly transmissive in the visible spectrum. A reflective surface gives an advantage in that the light will more uniformly reflect compared to a human eye, which also moves slightly as the sniper examines the target scene. A disadvantage is that it provides one more component for the sniper rifle (which is generally undesirable in military settings as snipers usually want to minimize the number of components they rely upon). Also, the reflection would likely be different from actual use conditions in which the eye is the reflective source.

The image of reticle 106, as illuminated along optical path A, therefore emerges with the reflected illuminating light from the front end of scope 106. This image, along with the rest of the reflected light, is transmitted/reflected along optical paths B, C and D. The light ultimately reaches photosensor, camera or other image capture device 414, which is generally sensitive to the specific wavelength(s) of the near infrared light. Camera 414 captures the illuminated image of reticle 106 and forwards the camera image in an appropriate digital or other format for further processing at processing electronics 418.

When the eye 402 is the reflector, the ideal image of the reticle 106 at the camera 414 typically occurs when the human eye 402 is at the exit pupil of the scope 104. That is, when the eye is present, the reflected illuminating light will produce a maximally bright and uniform illumination of the reticle 106. Maximum brightness and uniformity will typically also occur when the reticle 106 is centered such that its conjugate image is centered to the camera 414.

Typically, the reflected image of the reticle is obtained under relatively ideal conditions during an initial calibration when the scope 104 is in the desired nominal alignment. This may be in ideal alignment per a zeroing of the reticle procedure, for example, or with an intentional offset introduced as is common, particularly for long distance shots). This provides a baseline image of reticle 106. During actual use, the image of reticle 106 is retaken as necessary (either continuously, intermittently on a predetermined frequency, on demand or sporadically as needed). In practice, processing electronics 418 suitably compare a currently-obtained image captured by the camera with the baseline image to determine the position of the reticle. This comparison may be performed using phase correlation or the like to determine how the scope 104 is aligned relative to its original recorded baseline position. For example, if the reticle 106 position has not been adjusted via knobs 112 or otherwise dislodged (via impact) since its baseline image was captured, then the currently-captured image projected by the reticle will be in the same position as in the baseline image. The processing module 418 can also use the baseline orientation to create projections on display 416, as described below. This would be of particular use for snipers that compensate through movement of the weapon rather than movement of the scope, as described above.

However, if the scope has been adjusted, then the processing electronics 418 will determine the differential in the reticle position and account for the offset during subsequent processing. This would generally be the case for snipers that adjust their scopes (reticles) during compensation. This could also apply to snipers who set their scopes at specific angles off of the ideal calibration to account for specific targeting environments (e.g., at extreme ranges where the weapon is pointed higher to account for gravity).

In cooperation with the processing electronics 418, then, the system 400 can be used to provide an initial baseline measurement of the position of reticle 106. Subsequent measurements will provide the reticle position of the reticle 106 relative to this baseline. As noted above, the spotter and/or the processing module 418 will utilize the information on the orientation of reticle 106 as part of the determining the compensation data for the sniper to adjust his aim. In the prior art, the resulting compensation data was communicated orally from the spotter to the sniper. In the embodiment of the reticle projection system 400, that information can be provided visually.

As discussed in more detail below, tests have been conducted to determine how accurately the above methodology determines the number of "clicks" a scope 104 may be out of its initial optical alignment. Test data showed that in over 90% of the measurements in which the above embodiment was used to compare the current reticle 106 position with its original baseline position, the determined position of reticle 106 was within half a reticle adjustment relative to manual positioning by counting the number of clicks. These test results show that the automatic reticle positioning concepts described herein can be at least as accurate, if not more accurate, in determining the actual reticle position of scope 104 in comparison to manually determining the position by counting the clicks. This optical methodology of automatically determining the relative position of the reticle can thus provide a reliable substitute for the manual counting methodology. Stated more simply, by using near infrared light and the reflective nature of the human eye, the above embodiment optically can, with accuracy suitable for the sniper environment, determine the current reticle of the scope 104.

Further, a display 416 can be used to provide feedback imagery to the sniper or other viewer. In general, anything displayed in display 416 using light in the visible band can be made to appear in the viewer's line of sight within scope 104. Specifically, any image invisible light displayed on display 416 will travel a long optical paths E, D, C, B and A directly into the sniper's eye 402. For specific use in the illustrated embodiment, the processing module 418 could generate a target symbol on the display 416 that represents the exact point at which the sniper should aim to compensate for the various conditions, as described more fully below.

In practice, spotter and/or processing module 418 calculates the necessary compensation as described above. Rather than providing that information as a number of clicks, however, various embodiments could allow the processor module to generate a specific optical symbol on display 416 that represents the desired correction for the sniper. The optical symbol may be, for example, a crosshair or dot that uses a color of light that is in the visible spectrum (e.g., red or green). For the sake of reference, this target symbol is illustrated in the application drawings as a crosshair.

The displayed symbol is thus a visual representation of the compensation data that takes into account the internal optics of the system 400 and the orientation of scope 104. More specifically, the processing electronics 418 can determine where the target symbol should be generated on the display 416, considering factors of intervening optics as well as the automatically-determined current alignment of the scope 104, such that the target symbol 502 appears on the reticle 106 at the precise location that the sniper needs to fire the weapon.

Figure 5A:
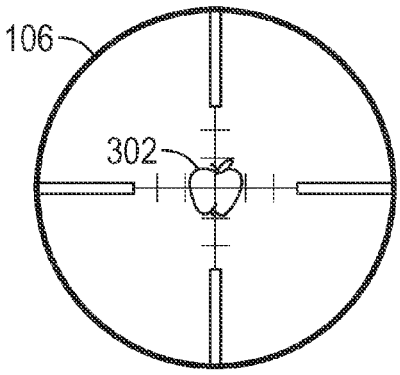
Figure 5B:
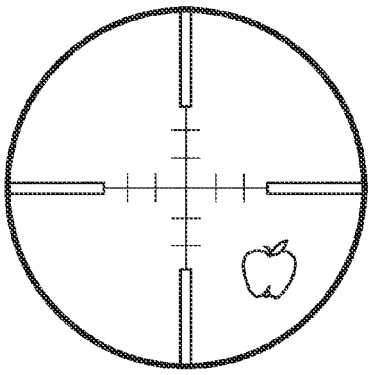

An example of such a process is shown in FIGS. 5A-B. The examples illustrated in FIGS. 5A and 5B are generally consistent with the prior art show in FIGS. 3A and 3B in that the reticle 106 in FIG. 5A is aligned on target 302. After compensation data is provided, and sniper realigns the weapon in FIG. 5B using an "eyeball" method. In the prior art, the compensation would have to be spoken by the spotter to the sniper, with the sniper making an "eyeball" adjustment to compensate.

Figure 5C:
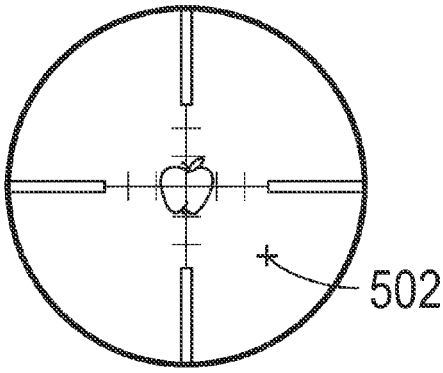
Figure 5D:
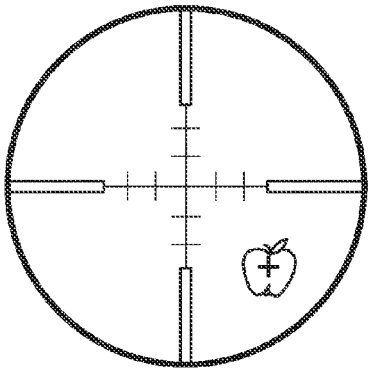

In the illustrated embodiment, the automatic compensation data appears visually in the sniper's scope 104 as target symbol 502 "+" in FIG. 5C. The sniper need simply move the target 302 into alignment with the target symbol 502 as shown at FIG. 5D, at which point the target 302 will be in the best available alignment with the weapon for firing of the bullet.

Figure 5E:
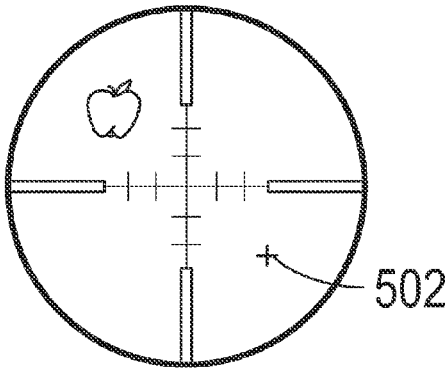
Figure 5F:
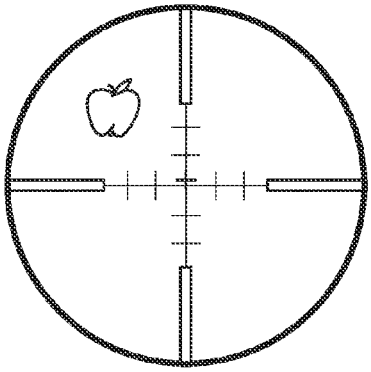

Referring now to FIG. 5E, suppose as an example that the sniper adjusts the orientation of the scope 104 via knobs 112 so that center of the reticle 106 aligns with spot shown by the target symbol 502. At the instant of change, the target symbol 502 would still appear in the view of the scope 104, but it would be in an incorrect position relative to the readjusted position of the reticle 106; the reticle position has changed, but display 416 is still displaying the target symbol relative to the earlier orientation of the reticle. Various embodiments, however, could quickly compensate by taking a new measurement of the reticle 106 using the near infra red methodology discussed above. The required compensation data changes accordingly, and the system changes the corresponding position of the target 502 in display 416 to appear in the proper location as shown in FIG. 5F.

The above embodiment provides substantial improvements over more conventional methods that rely upon manual measurement and communication. The potential elements of human error in communicating and applying the number of "clicks" between the spotter and the sniper are suitably eliminated. Similarly, latency (e.g., the amount of time for the spotter to communicate compensation data to the sniper and for the sniper to make corresponding adjustments) can be appropriately minimized to the speed of the optics and intervening electronics, and the sampling speed of components that monitor the incident factors. The accuracy is also improved in that the smallest degree of shift in the prior art was a single "click," whereas the target symbol 502 can essentially be placed with accuracy consistent with the resolution of display 416, and in theory at an accuracy of less than a reticle "click" adjustment.

Figure 7:
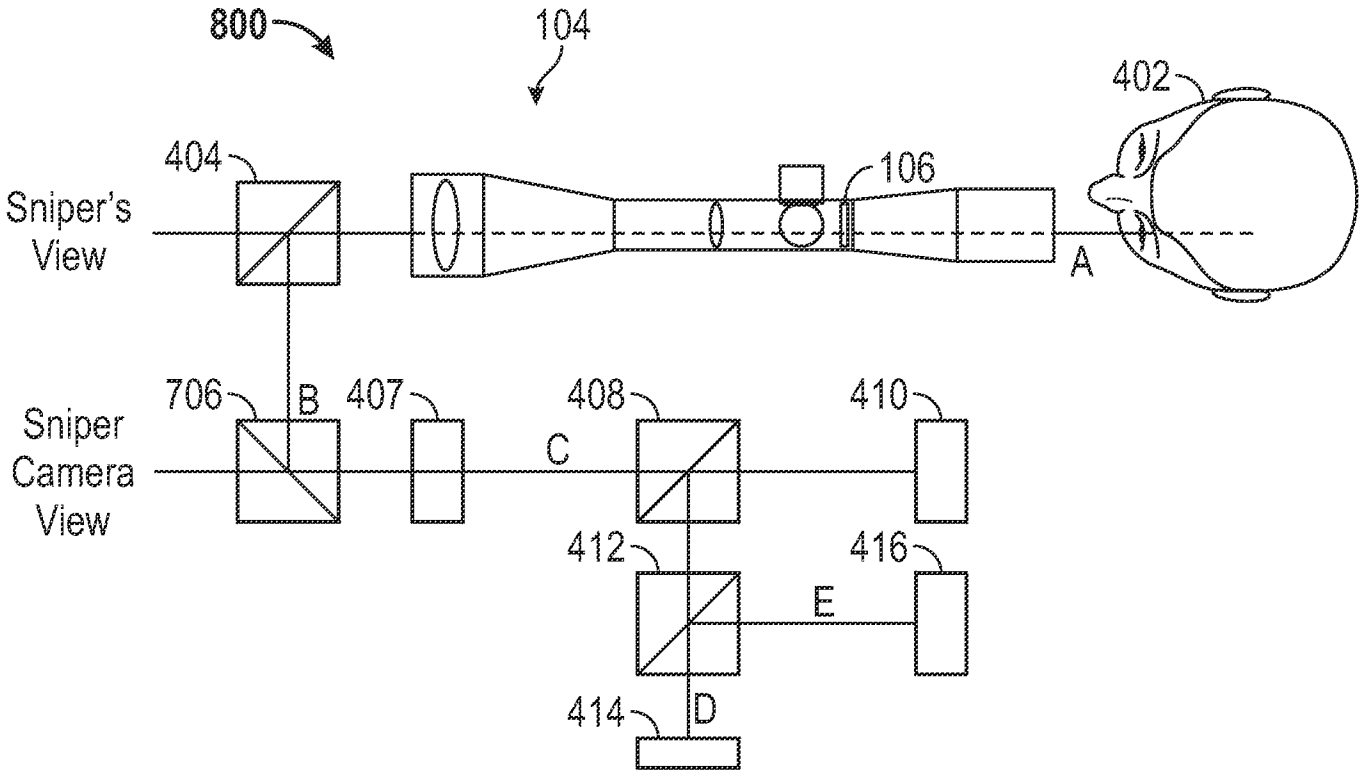
FIG. 7 is a block diagram of an exemplary system that includes input from an external image capture device.
Figure 8:
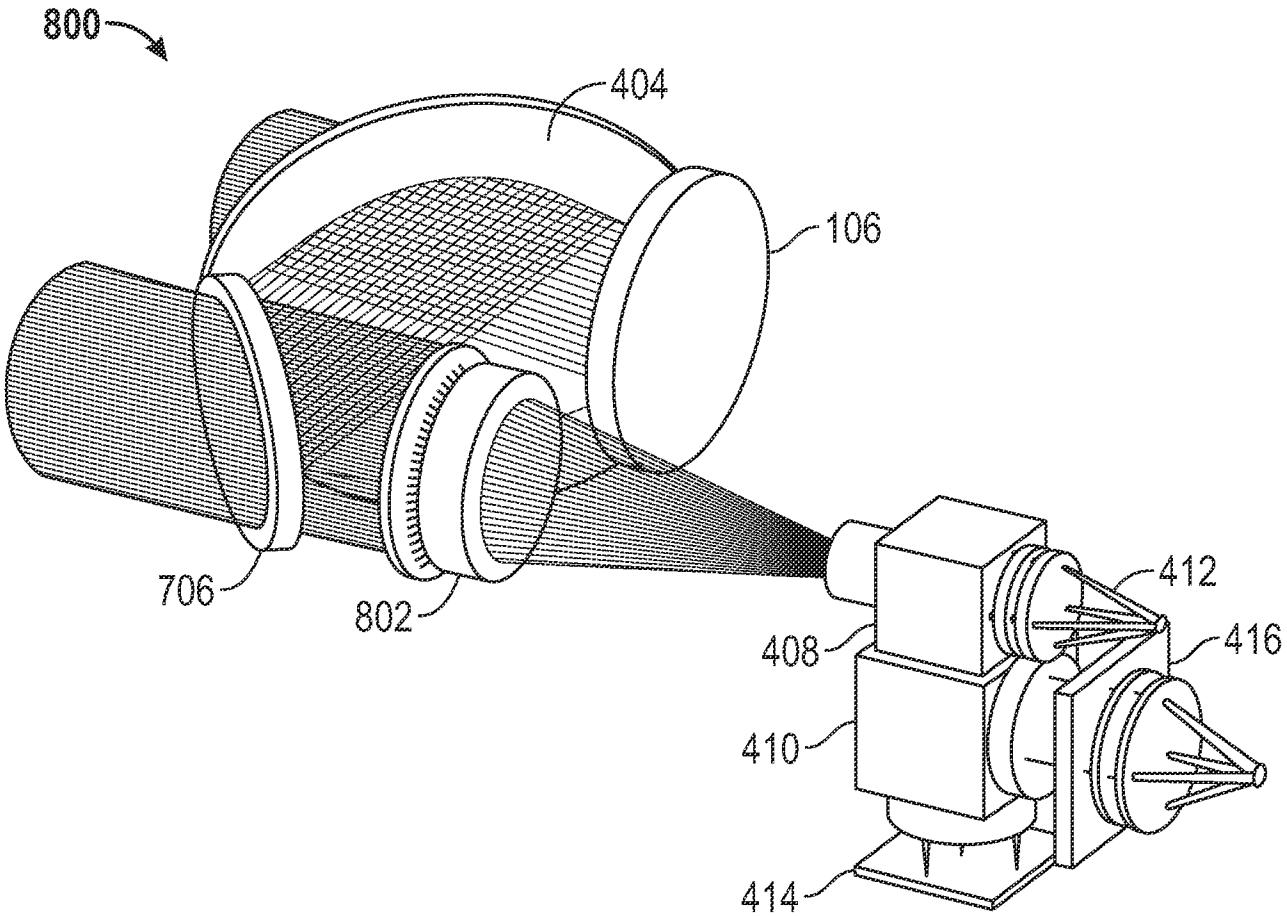
FIG. 8 is an additional view showing an exemplary external image capture device.

Referring now to FIGS. 7 and 8, another embodiment of a reticle projection apparatus 800 is shown. Apparatus 800 is generally the same as system 400, except that mirror 406 has been replaced with a beam splitter 406. Beam splitter 406 permits light transmission along optical path C, thus creating a "sniper cam view" marginally offset from the actual sniper's view. This sniper cam view is detectable to camera 414 and can be recorded or monitored for other uses. The sniper cam can also be viewed in real time by a spotter using an appropriate display. FIG. 8 shows exemplary components including an objective lens 820 and other internal optics in a perspective view.

Beam splitter 706 preferably has characteristics that do not otherwise interfere with the other operations of the system 400 and/or the overall functions of being a sniper. Thus, beam splitter 706 is preferably minimally transmissive of visible light so that visible light from display 416 is minimally visible to the target. Similarly, beam splitter 706 is preferably minimally transmissive of the near infra red light from light source 410 to prevent light from escaping and reducing the volume of light available to illuminate reticle 106. In some embodiments, this reduction in light could be compensated with increased brightness of the light source, noting that this increased brightness could undesirably act as a power drain.

The characteristics of beam splitter 706 is preferably less than about 5% transmission, and at least about 80% reflection of visible light in 390-750 nm wavelength, and potentially more narrowly at 450-650 nm. At the wavelength of the near infra red light, the reflection is preferable about 80% in various embodiments. The transmissive restrictions can be reduced for other non-visible wavelengths above 650 nm or below 450 nm, as these are minimally detectable.

In the above embodiments, display 416 can be limited to a type that (1) operates in a narrow wavelength of light necessary to generate the target symbol 502, and (2) only displays the target symbol. However, the invention is not so limited, and display 416 may be a fully functionally display, such as an LCD display. A KOPIN militarized transmissive display is on example of a display suitable for this purpose, with VGA or SVGA for basic capability; Other exemplary components that could be used to construct system 400 could include an APTIMA MT9V032DOOSTM 752H×480Y CMOS processor; SXGA may be used for certain enhanced capabilities, discussed below; a SONY ICX274AL 1600 (H)×1200 (V) CCD may be used for this purpose. Using the appropriate display, any tactical relevant imagery can be displayed in display 416 for presentation to the viewer's eye with the viewing imagery within telescope 104.

In practice, the combination of the camera receiving both the sniper cam view and the illuminated reticle 106 may conflict. In such embodiments, the system could periodically turn off (or otherwise modulate) the illuminating light source to get a clean image on camera 414 when needed. The system then turns on the near illuminating light source 410 to overlap the reticle 106 on the image, and then "subtracts" the prior image out, leaving only the image of reticle 106 behind. This process could occur at the millisecond level (or on any other temporal basis) and thus may not be noticed by the spotter or sniper. This process could be carried out by the processing and/or onboard electronics, as appropriate.

The displayed information is suitably generated and presented in a manner that is configured to be manipulated by the intervening optics of system 400 and display in proper alignment within the line of sight of the current orientation of scope 104. This latter feature is of particular value when another camera is involved, particularly a spotter's camera.

Figure 9:
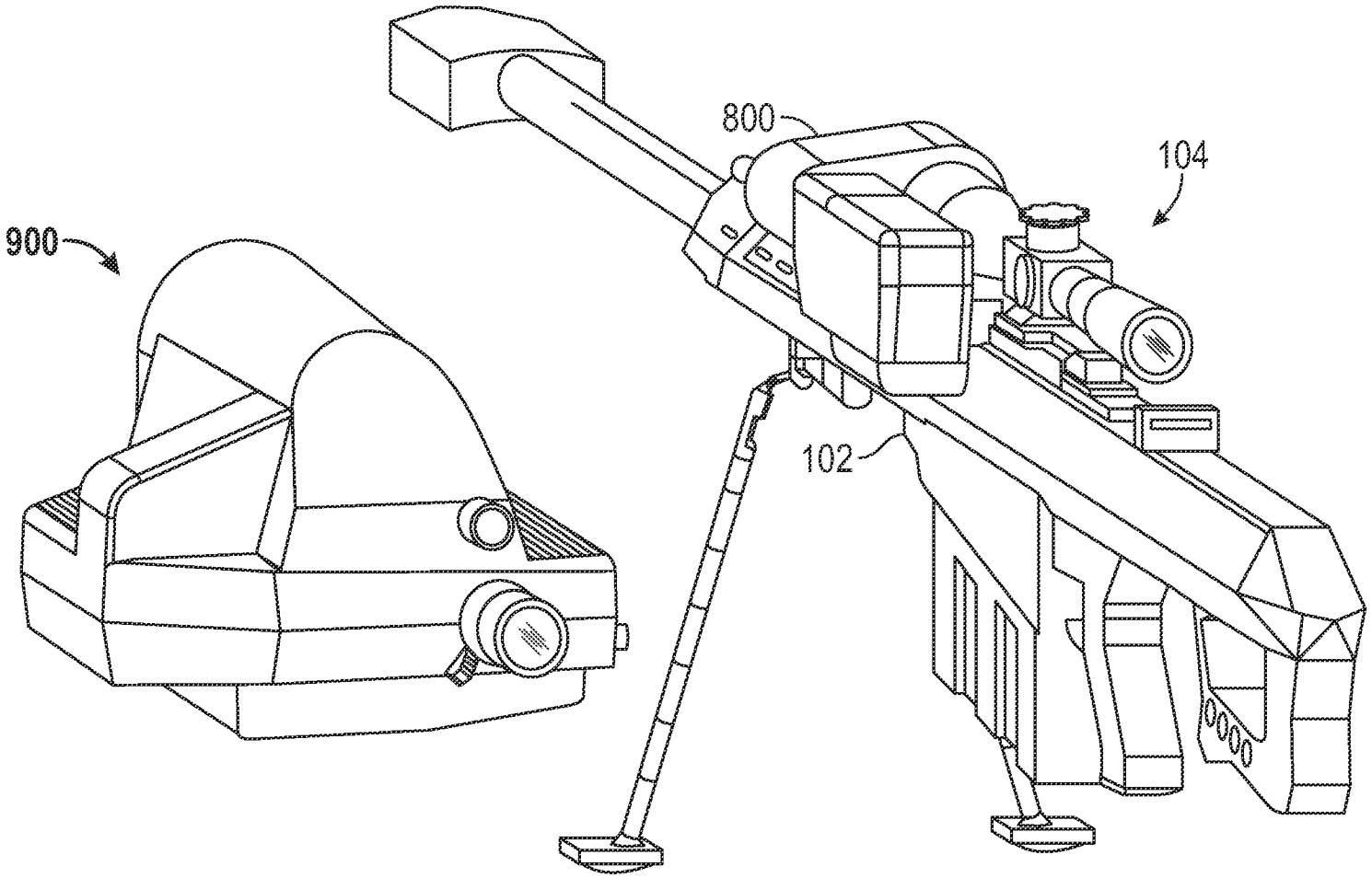
FIGS. 9 and 10 are views of exemplary embodiments that incorporate an external image capture device.

Referring now to FIG. 9, another exemplary embodiment is shown. In this embodiment, the apparatus 800 operates in conjunction with an independent spotter's camera 900. The processing electronics 418 noted above can be integrated into the spotter's camera 900, or it can be a separate component as desired. System 400 could also be used, although the lack of a sniper camera view may limit the synergy of system 400 with spotter's camera 900.

Figure 10:
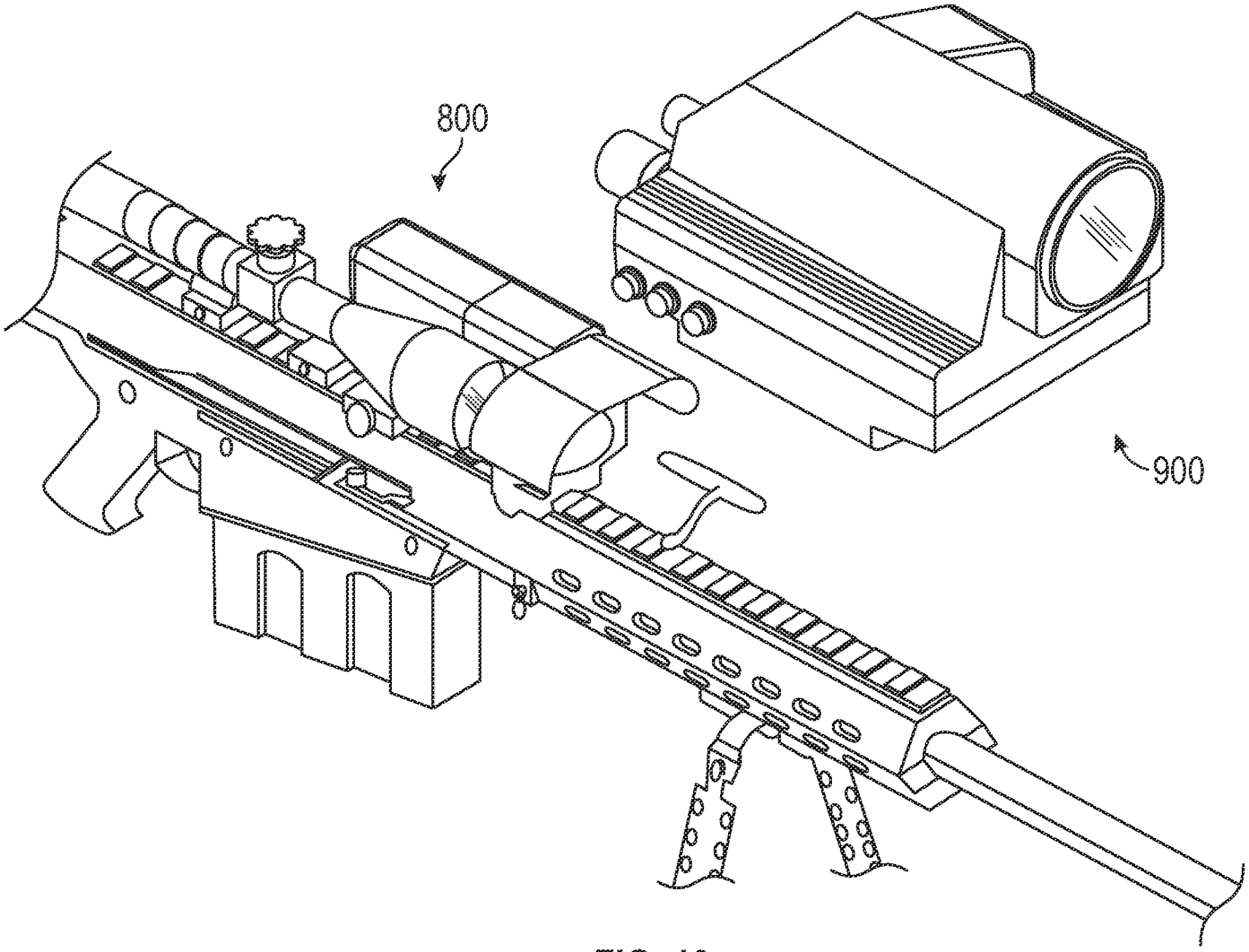

The spotter's camera 900 is preferably more powerful and versatile than the camera elements of reticle projector apparatus 800. The primary reason for this is that the capabilities of the sniper's optics are generally limited by its size. As seen in FIGS. 9 and 10, spotter's camera 900 can be much larger than the sniper's, so it may be able to provide greater capabilities in terms of a greater degree of magnification, ability for use in certain lighting conditions, infrared use, etc. The spotter's camera 900 and the sniper's camera can nevertheless work together in ways that improve communication in the spotter-sniper relationship.

As one example, information between the two views can be shared and presented to the sniper via the telescope 106 using display 410. The processing electronics can compare the image from the spotter's video camera and identify exactly what that spotter is centering his reticle on. Using know n image comparison technology, the processing module can determine and overlap each team member's line of sight is, and overlap it onto the other's view.

Figure 11A:
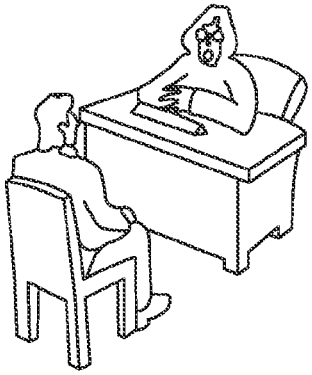
Figure 11B:
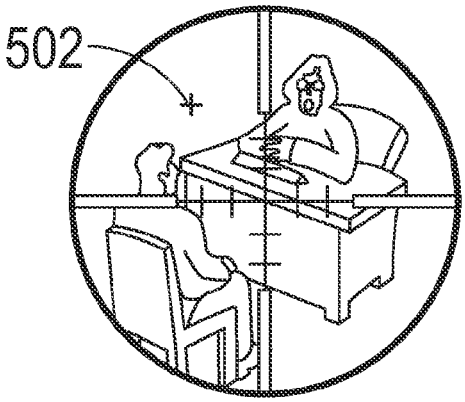
Figure 11C:
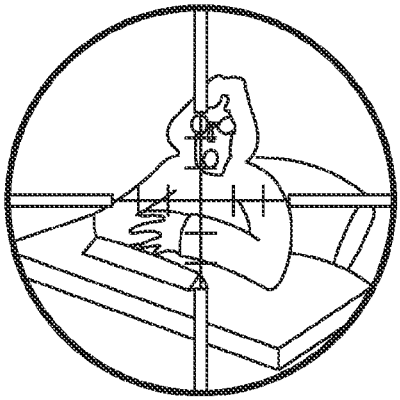

For example, in the spotter-sniper relationship, it is often the responsibility of the spotter to specifically identify the target. Consider FIGS. 11A-C in which the devices are not initially cooperating. In this example, FIG. 11A shows two participants at a meeting. One is the target, and the other is a bystander. The spotter's view is shown in FIG. 11C; with the superior magnification of the spotter's camera, the spotter identifies the target. The sniper's view, shown in FIG. 11B, is of both individuals, but due to magnification restrictions the sniper's view does not allow identification of which person is the specific target. The target symbol 502 is provided, but the sniper does not know which individual to place the target symbol on in this instance. Using conventional techniques, the spotter would orally guide the sniper to the correct target, such as by stating that the target is "behind the desk", or the like.

Figure 12A:
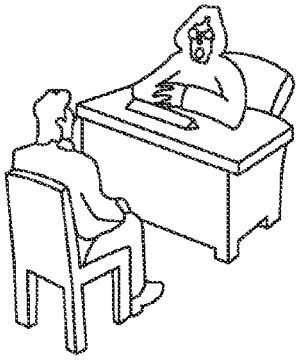
Figure 12B:
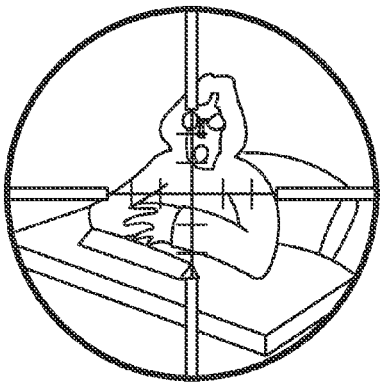
Figure 12C:
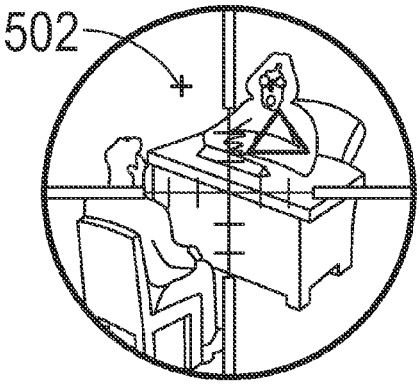
Figure 12D:
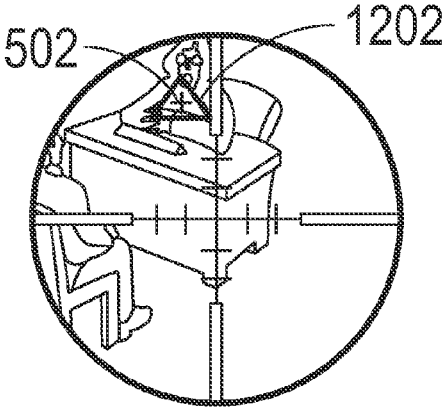
Figure 12E:
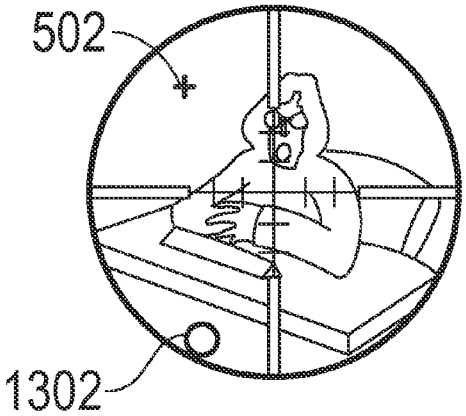
Figure 12F:
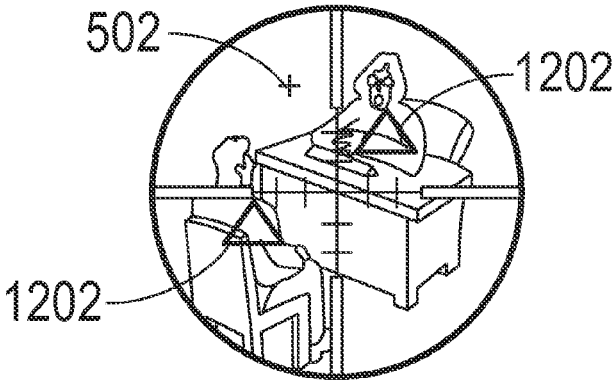

Consider now in FIGS. 12A-C where the images of both cameras are compared and the information shared. The meeting as shown in FIG. 12A is the same as in FIG. 11A, but in this instance the processing module 418 determines the line of sight of the spotter's camera and causes a corresponding spotter symbol 1201 (in this case a triangle) to display on display 416. The spotter's symbol 1202 thus appears in the sniper's field of view, indicating the exact spot relative to the current orientation of the sniper's reticle 106 at which the spotter is looking Referring now to FIG. 12D, the spotter simply needs to align the target symbol 502 with the spotters' symbol 1202, and fire. The entire process in this example was carried out by cooperation of the spotter and the sniper without any oral communication.

Figure 13:
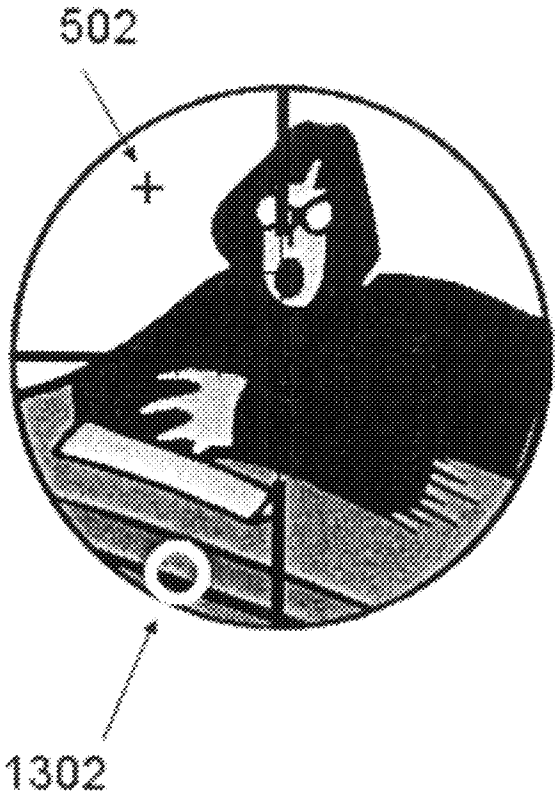

Conversely, the sniper's information can be viewed in the spotter's display as shown in FIG. 13. FIG. 13A is an example of the spotter's view of the situation in FIG. 12B in which the targeting symbol is off to the upper left while the sniper's reticle is centered at the desk. The position of these symbols would move in the spotter's display as the sniper realigns the position of the reticle.

Figure 14:
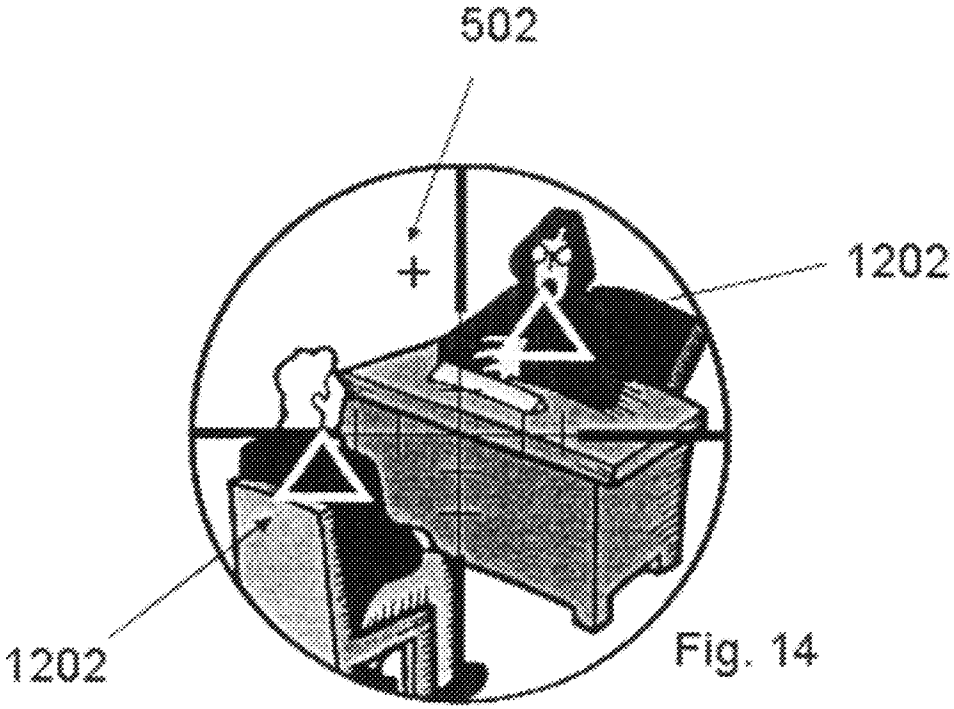

Another type of synergy produced from various embodiments is through marking of targets. As above, the spotter can isolate a specific target for the sniper. But instead of using the active line of sight, the spotter can mark the target by having the spotter's camera 900 "lock" the image. A corresponding lock symbol is suitably displayed on display 416 to appear in the sniper's line of sight as to where the spotter's target was marked. The sniper can overlap the lock symbol and the target symbol 502 as desired, and then fire as in the above embodiments. The advantage is that the spotter need not stay on that target, but can focus his attention on other matters. Also, as shown in FIG. 14, multiple target symbols 502 can be locked so that the sniper can fire in succession; different colors or symbols could be used to identify priority targets.

Another type of synergy that may be provided in some implementations is to leverage the superior optical capabilities of the spotter's camera 900 for the sniper's view. The display 416 can project image processed scenes directly overlaid on the sniper scope view to provide enhanced contrast, such as hazy conditions that the spotter's camera 900 can better compensate for using infrared. A feature detection algorithm may be present to extrapolate feature points in an image, generate a silhouette and display that silhouette in display 416 for view of the spotter's eye.

Various embodiments may further equip system 400/800 and/or the spotter's cameras 900 with a position sensor such as a GPS receiver (e.g., a Trimble C1919 or the like) and/or an Attitude and Heading Reference System (AHARS) such as a MicroStrain 3DM-GX3-25 or the like, to allow for additional cross referencing between the systems. Positioning data may be supplied either as an alternative or as a supplement to the overlapping comparisons performed via image processing as described above.

In still further embodiments, the spotter and sniper scopes could "paint" a panoramic view in image memory of the target area from their fixed vantage points for relatively static target scenes. They could then mark and collaboratively reference this larger filed of view as desired. This may reduce the need for the AHARS or other positioning data, but does not provide cueing prior to the generation of the panoramic image in many implementations.

Registration between the lines of sight at all points in the field of view would be maintained by techniques applicable to image fusion as the baseline between the spotter and sniper increases or as the image acquisition devices vary by field of view, distortion, spectral band, and/or the like. In some embodiments, the sniper could potentially use the spotter's enhanced image to take the shot by blocking the sniper scope aperture and then viewing the electronically-projected image in the scope 104. In this example, the scope 104 would be only displaying the Spotter's view registered to the aimpoint; other embodiments may combine spotter and sniper visual imagery in any manner.

Referring now to FIG. 15, a block diagram of an exemplary embodiment including the image reticle projection apparatus 800, processing electronics 418, and spotter's camera 900 is shown with various features described herein. In this example, the reticle projection apparatus 800 includes an LCD panel and corresponding illumination LED as the cameras 416. An image sensor corresponds to camera 414. A NIR reticle LED corresponds to the near-infrared illuminating light source 410. Further, a temperature sensor monitors temperature of the weapon and/or ammunition, which is a condition that may factor into the compensation data. AHARS and GPS data may also provide additional special and geographic information as desired.

Processing module 418 in this example includes a symbology/image generation section that is responsible for controlling display 416 to project the desired symbols/images, such as target symbol 502. An image processing section receives the imagery from the image sensor for further processing, such as feature extraction (e.g. edge, SIFT, blob), sniper/spotter image co-registration accelerated by known optical properties such as known approximate relative line of sight, and enhancement of imagery for display on display 416 for optical fusion with scope 104.

A reticle apparatus control section controls, among other things, the illumination of the near infrared LED to produce illuminating light. A geolocation section receives information from the GPS and AHARS. A ballistic calculations section considers weapon related conditions, such as: measured reticle location, parallax and other optical geometry (including the interior optics of the reticle projection system 400/800), AHARS/GPS aided drop determination, windage with image alignment, and/or ammunition and weapon temperature. The exact list of factors to be accounted for is known to those in the art of sniper conditions and are not otherwise listed herein.

Spotter's camera 900 in this embodiment suitably includes a display that presents the imagery viewed by the camera and any additional symbols and/or information as may be applied by the symbology/image generation section of processing module 418. An image sensor within the camera feeds captured image data to the image processing section of processing module 418, as appropriate. A windage measurement section, which may measure wind locally or at different locations between sniper and target) feeds the ballistic calculation section. GPS and AHARS feed the ballistic calculations section. An interface and control allows the spotter access to the system via reticle control section in processing module 418. Again, other embodiments may have additional and/or alternate components that are differently arranged in any manner.

It is to be understood that the various modules and sections discussed herein that perform various calculations are preferably executed by software implemented on electronic computer hardware. The invention is not limited to the form of the implementation of the modules and/or the algorithms that they apply. For example, the reticle projection systems shown herein could be equivalently used with different and/or additional cameras other than a spotter's camera, such as a camera mounted on a ground or air vehicle. The only limits are those of the image processing software's ability to compare and correlate respective views so that information can be shared. In the alternative, to the extent image comparison is not possible, then the information can be more indirectly compared via GPS and/or AHARS as noted above.

Either the reticle projection system 400/800 or the spotter's camera can be supplemented with a laser pointer, which may enhance image registration in some implementations. In a full image hand-off mode, the laser could enable registration of any available spotter sensor imagery (e.g., thermal or the like). A standard sniper clay scope with a reticle projection apparatus could then project aligned and "actionable" target imagery in any conditions in which the spotter scope functions, as desired.

As discussed above, an embodiment of reticle system 400 was constructed and tested to determine the accuracy of detecting the orientation of the reticle 106 relative to its baseline positions. The relevant equipment test components in this example were as follows: Leupold Mark 4 10×40 mm LR/T M1 scope as scope 104 with MOA (minute of arc) tactile click windage and elevation adjustment (set to 73 micro-radian increments in this example) and Tactical Milling Reticle® (TMR®); 50 mm EFL lens as objective lens 407, 7.62°×5.98° FOV and 104 microradian IFOV; an 850 nm LED with approximately 25 nm bandwidth for near infrared light source 410; an LCD display with 590 nm LED illumination available with approximately 25 nm bandwidth as display 416. Other examples and embodiments may use any number of different components configured in any manner. The measurements in this example were only referenced to riflescope tactile clicks, and not an external reference. Measurement error in this instance therefore included the riflescope adjustment mechanism errors, instability of the mounting of the riflescope and reticle projection apparatus. Again, other scenarios may operate differently and/or may produce different results.

The method of locating the reticle for a single measurement in this example was as follows: (1) 8 bit monochrome images saved from camera demo software; (2) images were processed using MATLAB Image Processing Toolbox; (3) sample and reference images were binarized with Extended-maxima transform; (4) resulting images were canny edge filtered; (5) processed sample and reference images were correlated; and (6) the centroid of the correlation peak was calculated. Other techniques could be equivalently used.

The method by which the reticle position was moved and monitored in this example was as follows: (1) riflescope reticle was zeroed in windage and elevation; (2) a 0,0 (w,e) coordinate image was acquired; (3) the reticle was moved to 1,1 (w,e), and an image was acquired; and (4) image acquisition was repeated until the 5,5 location was reached. In this example scenario, the whole cycle repeated from 0,0 for a total of 5 runs, and 5 more images were acquired with no reticle movement at 0,0. Again, other scenarios may operate differently or provide different results.

The test data resulting from this example is shown in FIGS. 16 and 17. From this test data, it could be concluded that in spite of the coarseness of the measurement setup and approach, about 90% of the measurements were within a half reticle adjustment increment (⅛ MOA) and the average error was less than 20 microradians (<1/12 MOA). This is on par with, if not superior to, the results achieved when reticle location is determined by manually counting of clicks, further confirming the value of automatic reticle determination as described herein.

It is noted that the foregoing examples have been provided merely for the purpose of explanation and are in no way to be construed as limiting of the present invention. While the foregoing often emphasizes the example of a sharpshooter or sniper aiming a rifle, equivalent concepts may be applied in sport shooting, target shooting, photography or any other situation. The concepts are not limited to applicability with firearms; equivalent concepts could be used to aim any other sort of weapon or projectile launcher, or any other type of pointing device including a camera, light, laser, or other device. While the invention has been described herein with reference to certain example embodiments, it is understood that the words which have been used herein are words of description and illustration, rather than words of limitation. Items described as "exemplary", for example, are intended as examples, and not necessarily as models or templates that must be duplicated in practical embodiments. Changes may be made, within the purview of the appended claims, as presently stated and as amended, without departing from the scope of the present invention. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims and their legal equivalents.

What is claimed is:

1. A system to provide feedback about a position of a reticule that is moveable within a telescope that provides a visual image to a viewer, the system comprising:

a light source configured to generate an illuminating light;

a camera configured to produce a captured image in response to received light;

optics configured to direct the illuminating light from the light source and through the telescope to the eye of the viewer so that the illuminating light reflects off the eye of the viewer toward the reticle and thereby illuminates the reticule with reflected illuminating light to thereby form an illuminated image of the reticle in an outgoing direction of the telescope, wherein the optics are further configured to transmit the illuminated image of the reticle in the outgoing direction to be received by the camera to thereby allow the camera to create the captured image representing the illuminated image of the reticle that is moveable within the telescope; and processing electronics configured to receive the captured image from the camera that is based upon the illuminating light and to determine the position of the reticle as the reticle moves within the telescope based upon a position of the illuminated image of the reticle within the captured image.

2. The system of claim 1 wherein the illuminating light is predominantly a near-infrared light, and wherein the camera is sensitive to at least one wavelength of the near-infrared light in the reflected illuminating light.

3. The system of claim 2 wherein the optics comprise a beam splitter that reflects the at least one wavelength of the near-infrared light, and wherein the illuminating light is directed toward the eye of the viewer on substantially the same optical path in which the reflected illuminating light is transmitted toward the camera.

4. The system of claim 1 further comprising a display configured to generate an image responsive to the position of the reticle on a display, and wherein the generated image is transmitted from the display to the telescope so that the viewer sees the generated image within the visual image provided by the telescope.

5. The system of claim 4 wherein the generated image comprises an indication representing a deviation of the reticle from an initial position within the telescope.

6. The system of claim 5 wherein the processing electronics are configured to initially capture a baseline image with the camera that indicates an initial position of the reticle within the telescope, and wherein the deviation is determined as a function of a difference between the baseline image and the captured image.

7. The system of claim 4 wherein the generated image comprises enhanced imagery obtained from a second optical input device.

8. The system of claim 7 wherein second optical input device is an external camera, and wherein the enhanced imagery comprises a target indicator corresponding to a target identified by an operator of the external camera.

9. The system of claim 1 wherein the telescope is a scope mounted to a weapon that is adjustable by a user to move the telescope independently of the weapon, and wherein the position of the reticle is determined with respect to the weapon.

10. A method to determine a position of a reticle that is moveable within a telescope, wherein the telescope provides a visual image to an eye of a viewer, the method comprising:

directing, by processing electronics, the production of an illuminating light that is directed through the telescope to the eye of the viewer so that the illuminating light reflects off the eye of the viewer toward the reticle to illuminate the reticle with reflected light and thereby form an illuminated image of the reticle in an outgoing direction of the telescope, wherein the illuminating light including the illuminated image of the reticle in the outgoing direction of the telescope is transmitted to a camera that produces a captured image; and determining, by the processing electronics, the position of the reticle based upon a position of the illuminated image of the reticle within the captured image.

11. The method of claim 10 wherein the illuminating light is predominantly a near-infrared light, and wherein the camera is sensitive to at least one wavelength of the near-infrared light.

12. The method of claim 10 further comprising generating an image responsive to the position of the reticle on a display, and wherein the generated image is transmitted from the display to the telescope so that the viewer sees the generated image within the visual image provided by the telescope.

13. The method of claim 12 wherein the generated image comprises an indication representing a deviation of the reticle from an initial position within the telescope and wherein the method comprises determining the deviation from the initial position of the reticle within the telescope based upon movement of the reticle within the captured image.

14. The method of claim 13 further comprising initially capturing a baseline image with the camera that indicates the initial position of the reticle, and wherein the deviation is determined by measuring a difference between the baseline image and the captured image.

15. The method of claim 12 wherein the generated image comprises a target indicator obtained from a second optical input device.

16. The method of claim 12 wherein the generated image comprises enhanced imagery obtained from a second optical input device.

17. The method of claim 16 wherein the telescope is a rifle scope and wherein the second optical input device is a camera associated with a spotter.

18. A device comprising:

a telescope comprising a reticle, wherein the reticule is adjustable by a user of the telescope to change the position of the reticule within a visual image of the telescope;

a light source configured to generate an illuminating light;

a camera configured to produce a captured image in response to received light;

optics configured to direct the illuminating light from the light source and through the length of the telescope toward an eye of the user so that the illuminating light reflects off the eye of the user to again pass through the length of the telescope in an opposite direction to thereby form an illuminated image of the reticle in the opposite direction, wherein the optics are further configured to transmit the illuminated image of the reticle to be received by the camera to thereby allow the camera to create the captured image representing the illuminated image of the reticle in the opposite direction; and processing electronics configured to receive the captured image of the reticule from the camera that is based upon the illuminating light and to determine the position of the reticle as the reticle moves within the telescope based upon changes in a position of the illuminated image of the reticle within the captured image.

* * * * *